US005396786A

United States Patent [19]

Bartholomew et al.

[11] Patent Number: 5,396,786

[45] Date of Patent: Mar. 14, 1995

[54] MACHINE AND METHOD FOR MANUFACTURING CROSSOVER FITTINGS

[75] Inventors: Richard A. Bartholomew, Strathroy; John J. DeRuiter, Kerwood, both of Canada

[73] Assignee: Mueller Industries, Inc., Wichita, Kans.

[21] Appl. No.: 31,812

[22] Filed: Mar. 15, 1993

[51] Int. Cl.[6] ..... B21D 9/15; B21D 15/03; B21D 26/02; B26D 1/60

[52] U.S. Cl. ..... 72/57; 72/58; 29/421.1; 83/54

[58] Field of Search ..... 72/54, 57, 58, 60; 29/421.1; 83/54

[56] References Cited

U.S. PATENT DOCUMENTS

| | | | |
|---|---|---|---|
| 3,105,537 | 10/1963 | Foster | 72/57 |
| 4,311,031 | 1/1982 | Schwarze | 72/133 |
| 4,403,938 | 9/1983 | Seach et al. | 425/393 |
| 4,488,425 | 12/1984 | Meikle | 72/389 |
| 4,704,886 | 11/1987 | Evert et al. | 72/57 |
| 4,815,308 | 3/1989 | Moroney | 72/57 |
| 5,003,853 | 4/1991 | Borzym et al. | 83/54 |
| 5,097,689 | 3/1992 | Pietrobon | 72/58 |
| 5,239,852 | 8/1993 | Roper | 72/58 |

FOREIGN PATENT DOCUMENTS

| | | | |
|---|---|---|---|
| 0010328 | 1/1980 | Japan | 72/57 |
| 0077934 | 6/1980 | Japan | 72/57 |
| 0590038 | 1/1978 | U.S.S.R. | 72/57 |
| 1349820 | 11/1987 | U.S.S.R. | 72/57 |
| 1355312 | 11/1987 | U.S.S.R. | 72/57 |

OTHER PUBLICATIONS

Metals Handbook, 8th Edition, vol. 4, Forming, prepared under the direction of the ASM Handbook Committee, "Bending and Forming of Tubing", pp. 308–317, 1969.

*Primary Examiner*—David Jones

*Attorney, Agent, or Firm*—Harness, Dickey & Pierce

[57] ABSTRACT

A machine for forming a metallic tubular section in which the tubular section is located, retained, has at least one end formed, filled with fluid that is then pressurized within the tube section, and bend formed into a predetermined shape, all at a single station of the machine. A second station, either coupled with or independent from the first station functions to locate a tube section, retain it, cut off a portion of the tube section, form at least one end of the tube section, and provide for removal of the tube section therefrom. The tube sections are preferably crossover fittings. The present invention further comprises a method of manufacturing a full crossover fitting and a method of manufacturing a half crossover fitting.

30 Claims, 8 Drawing Sheets

MACHINE AND METHOD FOR MANUFACTURING CROSSOVER FITTINGS

BACKGROUND OF THE INVENTION

This invention relates generally to a machine and a method for forming and bending tubing, and specifically a machine and a method for manufacturing full crossover fittings and half crossover fittings, both of which have a central bend and at least one cup end.

Older buildings and structures are constantly being renovated. As part of these renovations, new and more complex plumbing is often installed. In many cases, the plumbing pipes or tubes are exposed on either the inside or outside of the building walls. However, due to pre-existing structural constraints and plumbing specifications many tubes must cross over one another, thus, necessitating the use of crossover fittings at these intersections.

Traditionally, crossover fittings are manufactured using a plurality of independent machines and a great deal of manual handling. For example, in one method a tube bender such as a Wallace machine may be used to make an initial 90° bend in a portion of raw tube stock. The raw tube stock is then mounted on an arbor rod containing two linked arbor balls which maintain the tube's inside diameter while the initial bend is created. After the tube is bent, the arbor balls are then retracted approximately 1 inch at which point a circular saw cuts a rough tube section from the raw stock. Within this traditional process, a further step requires a bend former machine where the tube section is loaded into a V-notch die and mandrels are inserted into each end. These mandrels aid in forming the bends near each end of the tube section. The tube section is then moved to a hand punch press machine where punches enter one end of the tube section to expand it against the outside dies, thus forming a cup. Next, the part is placed into another hand punch press machine which sizes the second end of the tube. Finally, the tube section is placed into a two-way facing machine which removes excess material on each end of the tube; the ends are cut and squared up in the facing machine when blades cut the tube around a pilot rod inserted thereinside. At this machine, the inside diameter of the tube cup ends are also chamfered. The full crossover and half crossover fittings can both be manufactured by this process.

SUMMARY OF THE INVENTION

In accordance with the present invention, a machine is provided for forming tubes. This machine has a first station which locates a tube section, retains the tube section, enlarges at least one end of the tube section, fills the tube section with fluid, pressurizes the fluid within the tube section, and bends the tube section while maintaining pressure. The machine of the present invention may also comprise a second station, either coupled with or independent from the first station, which locates a tube section, retains the tube section, cuts off a portion of the tube section, forms at least one end of the tube section, and provides for removal of the tube section therefrom. The tube sections are preferably crossover fittings. A further aspect of the present invention comprises a method of manufacturing a full crossover fitting and a method of manufacturing a half crossover fitting therefrom.

Both the automatic crossover machine, including its first station, the punch and shear functions of the second station, and the tube forming methods disclosed, significantly increase part productivity, hold better tolerances within the formed fittings, maintain wall thicknesses more consistently and reduce handling errors. Thus, the present invention has many advantages over the prior art tube forming machines and processes.

Additional objects, advantages and features of the present invention will become apparent from the following description and appended claims, taken in conjunction with the accompanying drawings.

DETAILED DESCRIPTION OF THE PREFERRED EMBODIMENT

In accordance with the teachings of the present invention, an improved machine and method for making crossover fittings is disclosed. In the preferred embodiment, the machine produces full crossover fittings at a first station and may modify some of these at a second station to produce half crossover fittings.

Figure 1:
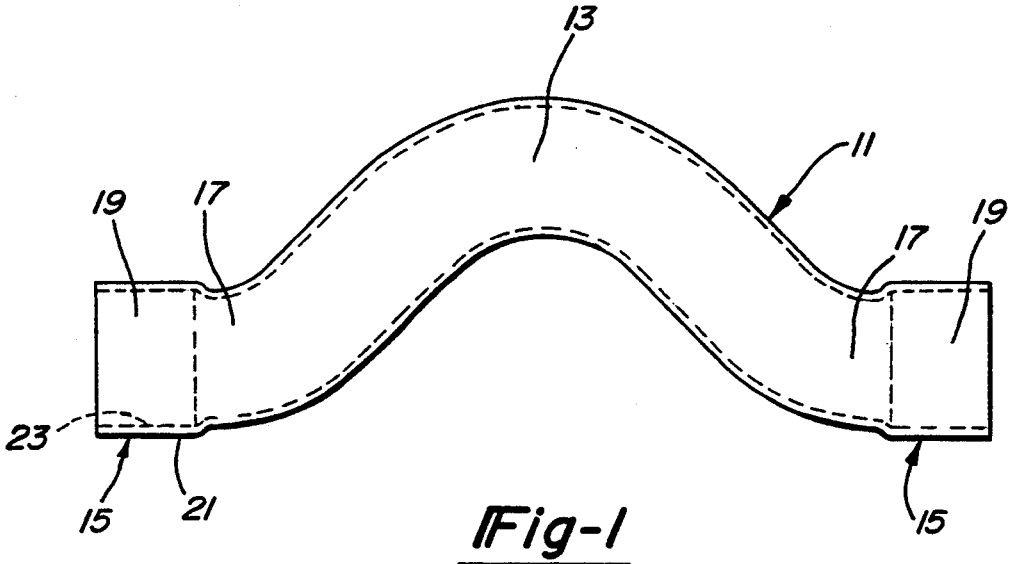
FIG. 1 is side view of a full crossover fitting made in accordance with the present invention.
Figure 2:
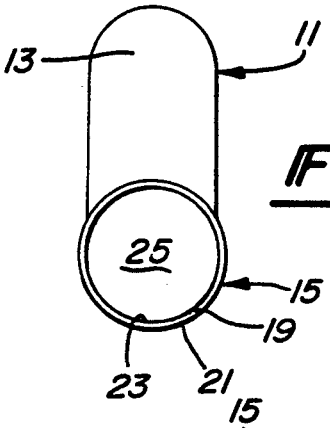
FIG. 2 is an end view of the full crossover fitting of FIG. 1.
Figure 3:
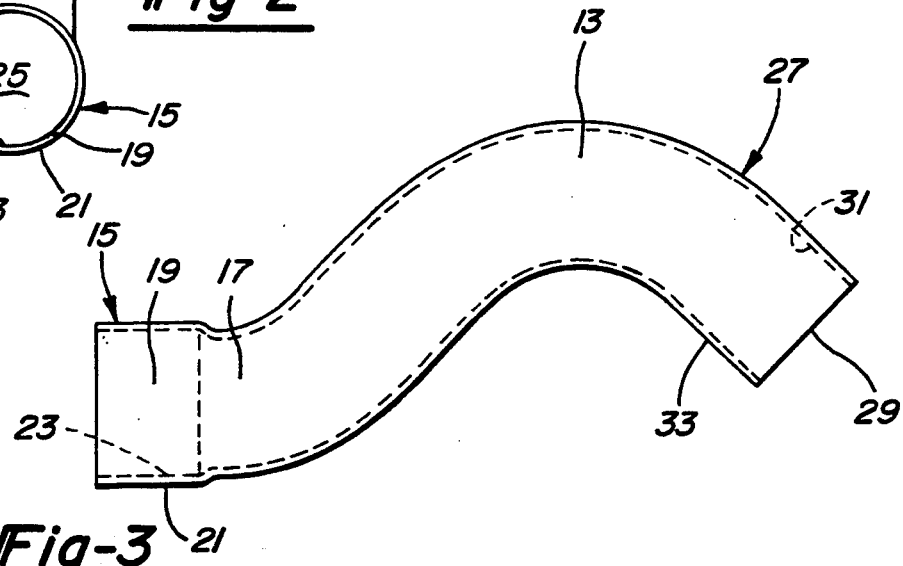
FIG. 3 is a side view of a half crossover fitting made in accordance with the present invention.
Figure 4:
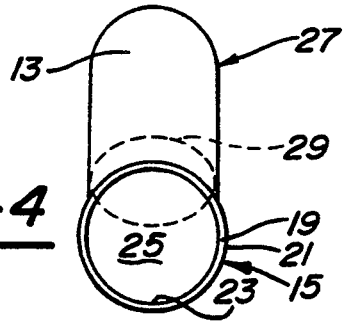
FIG. 4 is an end view of the half crossover fitting of FIG. 3.

Referring to FIGS. 1 and 2, a full crossover fitting 11 which may be made by the present invention is shown. The full crossover fitting 11 is made from a soft copper tube and has a central bend 13 bordered by two ends 15 axially in line with one another. Ends 15 are known as the "run" 17 of the part and have enlarged cup sections 19 thereupon for mating and connecting with adjacent tubes. The fitting 11 has a wall thickness determined by the difference between an outside diameter 21 and an inside diameter 23 and has a cylindrical opening 25 on each end thereof. The full crossover fitting 11 is called a partial blank 39 prior to having the cups 19 formed thereupon. A half crossover fitting 27 which also may be made by the present invention can be observed in FIGS. 3 and 4. The half crossover fitting 27 has a geometric shape substantially identical to that of the full crossover fitting 11 (therefore, similar numbers will be utilized for similar portions thereof), except that the half crossover fitting 27 has one of its run ends 17 cut off; the resultant end after the cut off is known as the "street end" 29. The street end 29 will have an inside diameter 31 and an outside diameter 33 substantially the same as the normal tube section. However, the other end is provided with a cup section 19 which is of similar expanded size and shape as cup sections 19 of the full crossover fitting 11.

Figure 5A:
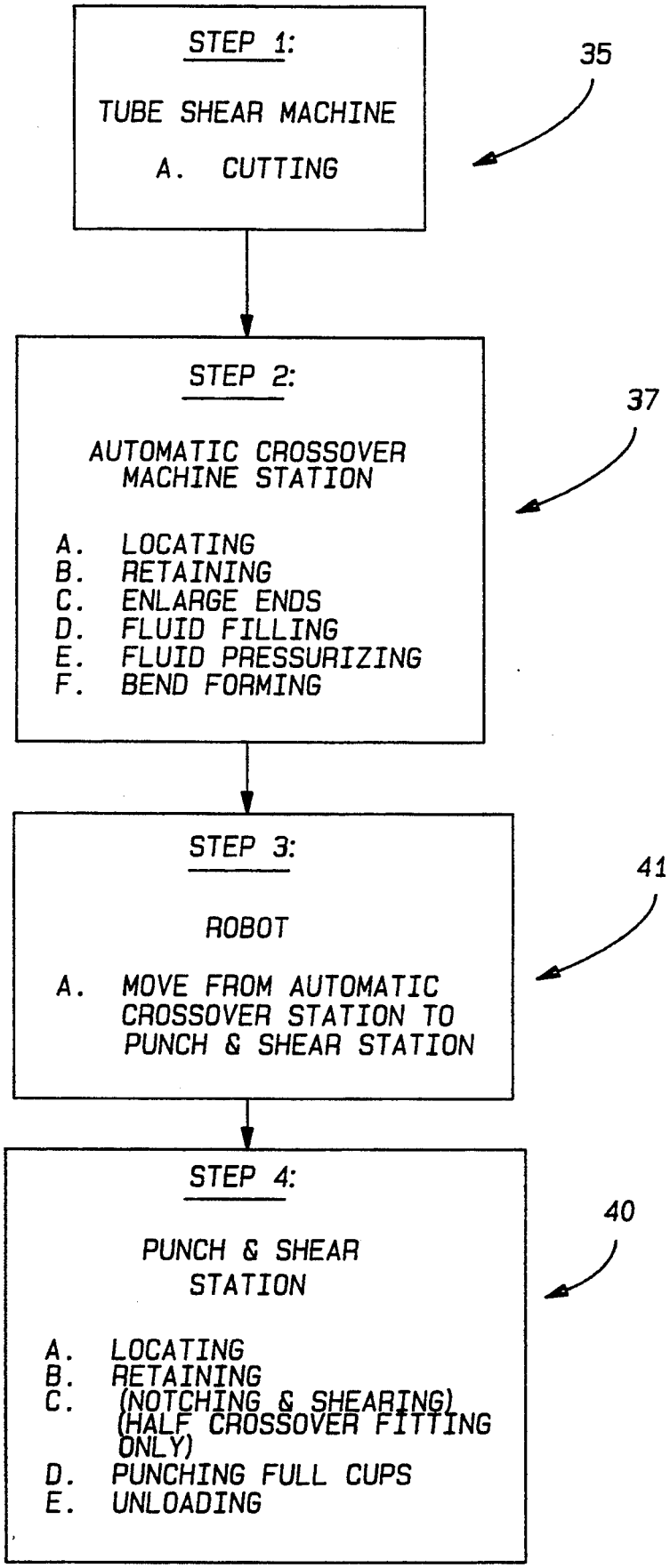
FIG. 5A is a diagrammatic illustration depicting the processing steps of one embodiment of the present invention.

Referring to FIG. 5A, a diagrammatic illustration is set forth depicting the steps for producing a full crossover fitting 11 in accordance with the present invention. In the first step, raw tube stock is cut to length in a conventional tube shear machine such as a Brehm machine. In such a shear machine, the raw tube stock is pushed along a mandrel, such as an arbor rod and the shear machine cuts the tube stock into a plurality of tubular sections each having a predetermined length.

The second step in the preferred embodiment is comprised of an automatic crossover machine which is referred to as station 37. In this station, a tubular section is located into and retained by a set of dies. A pair of punches then enter each end of the tubular section thereby slightly enlarging the cup ends for retention during the subsequent forming. These punches also contain means for filling and pressurizing the tubular section with fluid. Next, a forming die bends the tube to its predetermined shape, thus creating a partial blank 39. A third step transfers the partial blank 39 to a station 40 through the use of a robotic arm 41. Then, in a fourth step the partial blank 39 is located into and retained in station 40, known as a punch and a shear machine, by a die set. A second pair of punches are then inserted into the ends of the partial blank 39 for forming the cups 19 and stamping an identification mark on the outside thereof. Thus, a full crossover fitting 11 is created. A half crossover fitting 27 can also be produced in station 40 from the full crossover fitting 11. For a half crossover fitting 27, prior to the cup punching operation, a notching and shearing operation, which will be further described below, cuts one run end 17 off of the full crossover fitting 11. Thereafter, a punch forms the street end 29 of what is now a half crossover fitting 27 and an opposite punch forms the cup 19 on the other end. Station 40 also automatically unloads the full and half crossover fittings, respectively 11 and 27, from the dies.

Figure 5B:
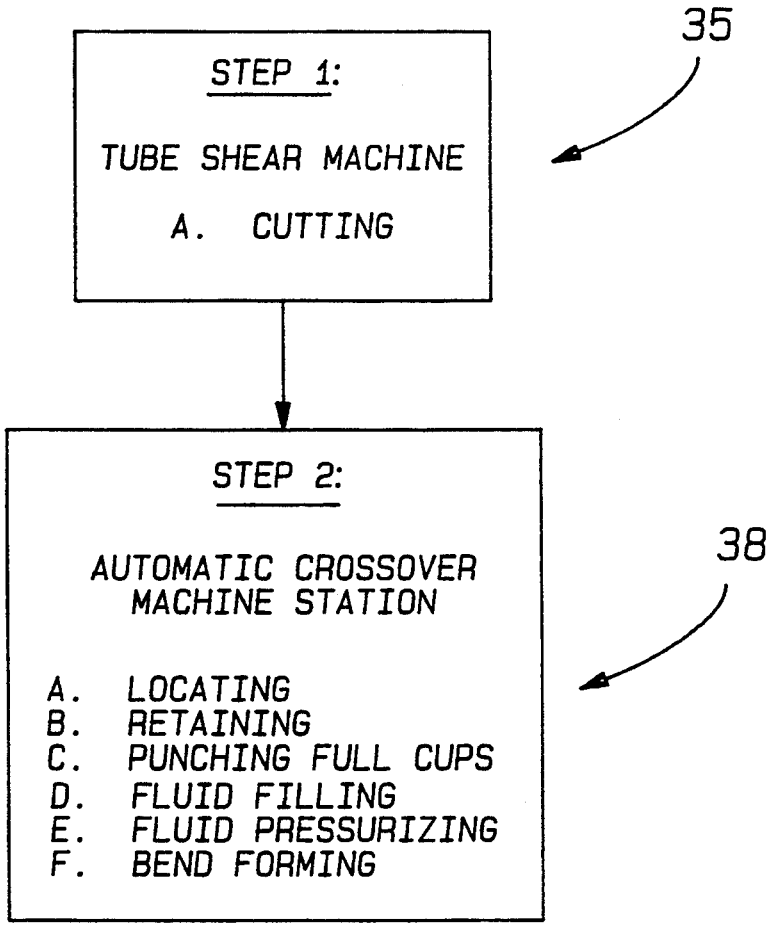
FIG. 5B is a diagrammatic illustration depicting the processing steps of a second embodiment of the present invention.

An alternative or second embodiment of the method is diagrammatically illustrated in FIG. 5B. In the first step, a tube shear machine 35 cuts a plurality of tubular sections from raw tube stock as described with respect to the first step of the method illustrated in FIG. 5A. The second step is comprised of a modified automatic crossover machine, which is referred to as station 38. In this station, a tubular section is located into and retained by a set of dies. A pair of punches then enter each end of the tubular section thereby completely forming the enlarged cup ends; these punches also contain means for filling and pressurizing the tubular section with fluid. Next, a forming die bends the tube to its predetermined shape and the completed full crossover fitting 11 is unloaded from the machine.

Figure 6:
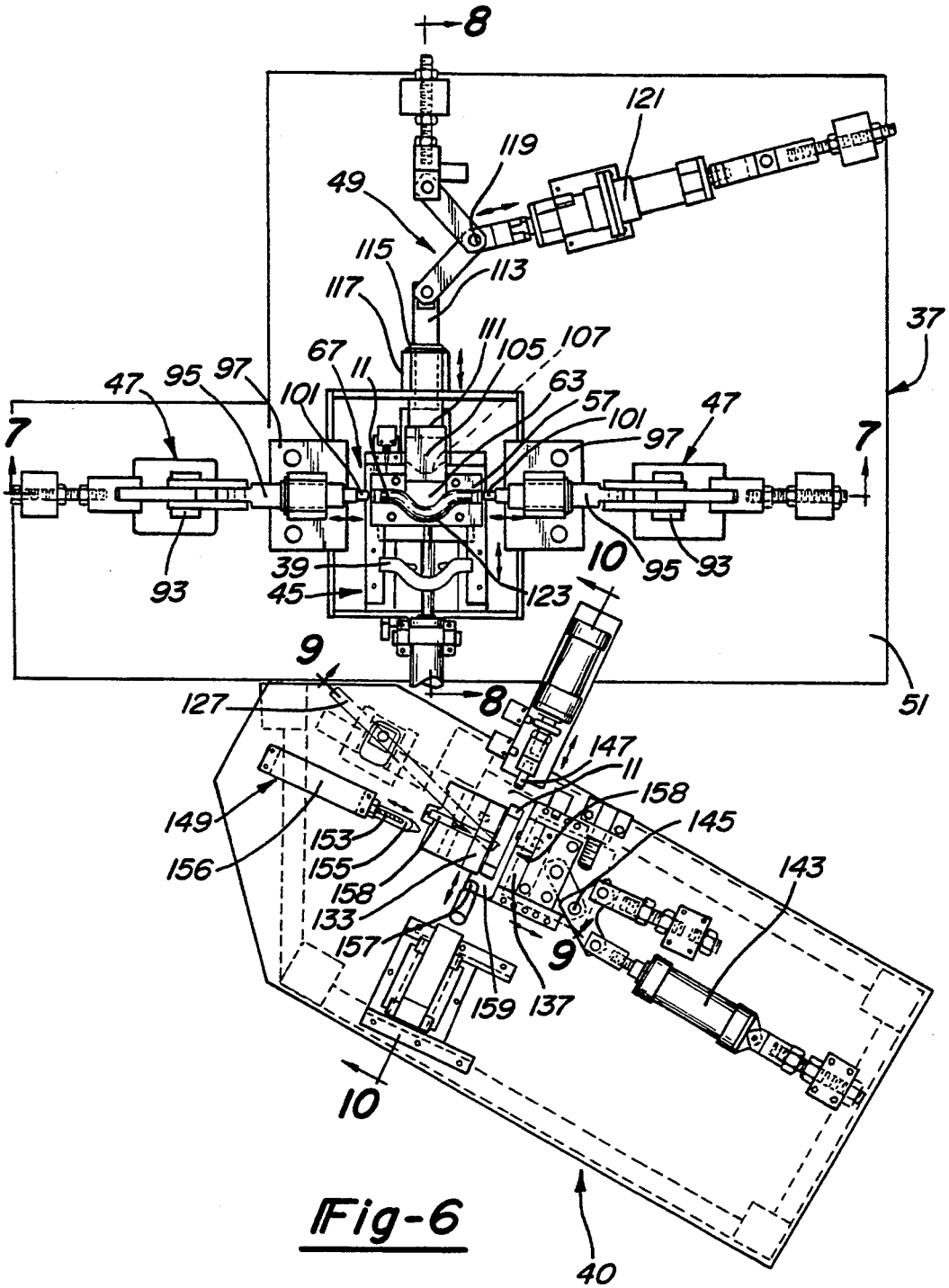
FIG. 6 is a cross sectional top view, oriented from the left side of the machine, showing a preferred embodiment of the tube forming machine of the present invention.
Figure 7:
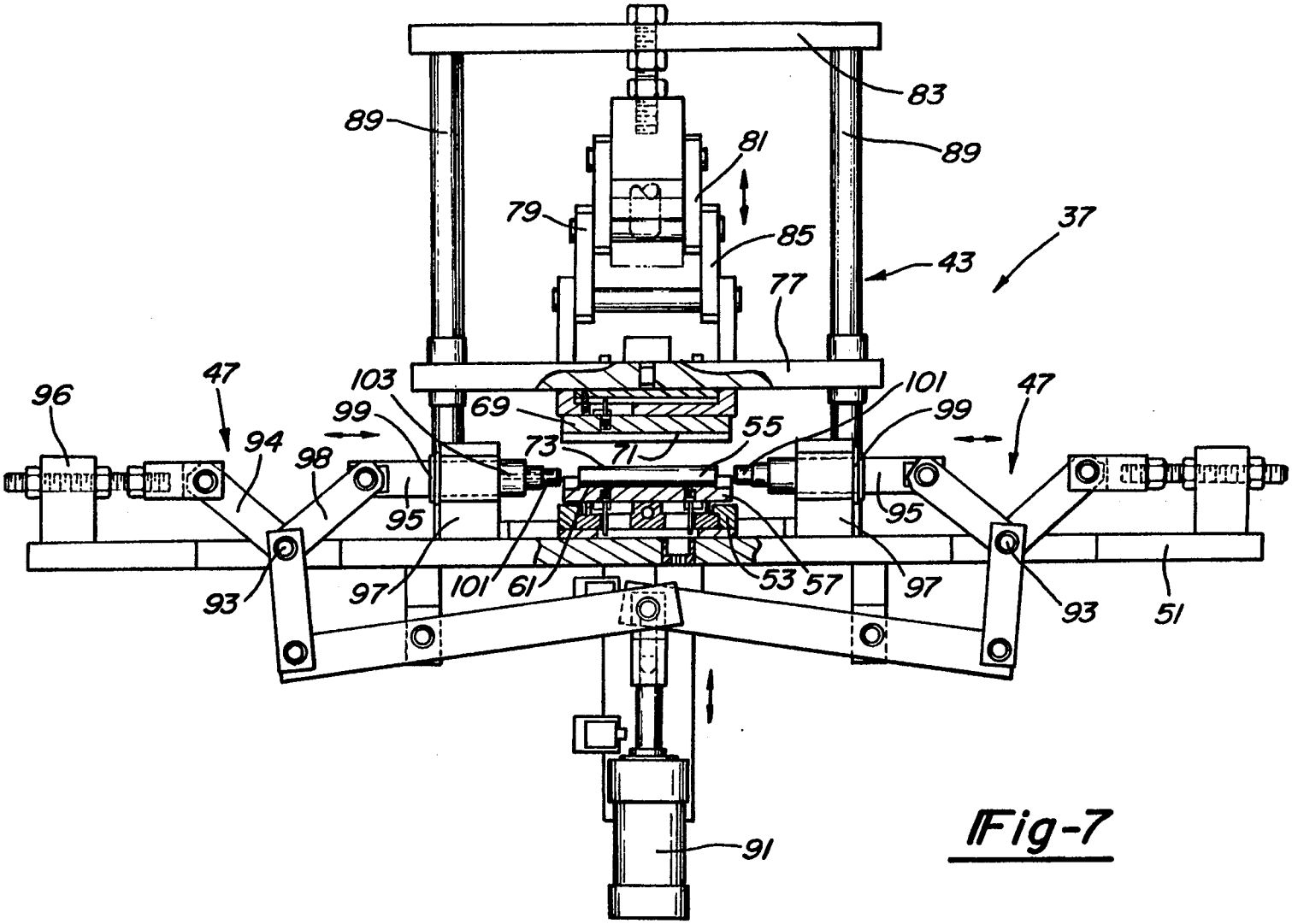
FIG. 7 is a cross sectional elevation view of a portion of the machine of FIG. 6 taken at line 7—7.
Figure 8:
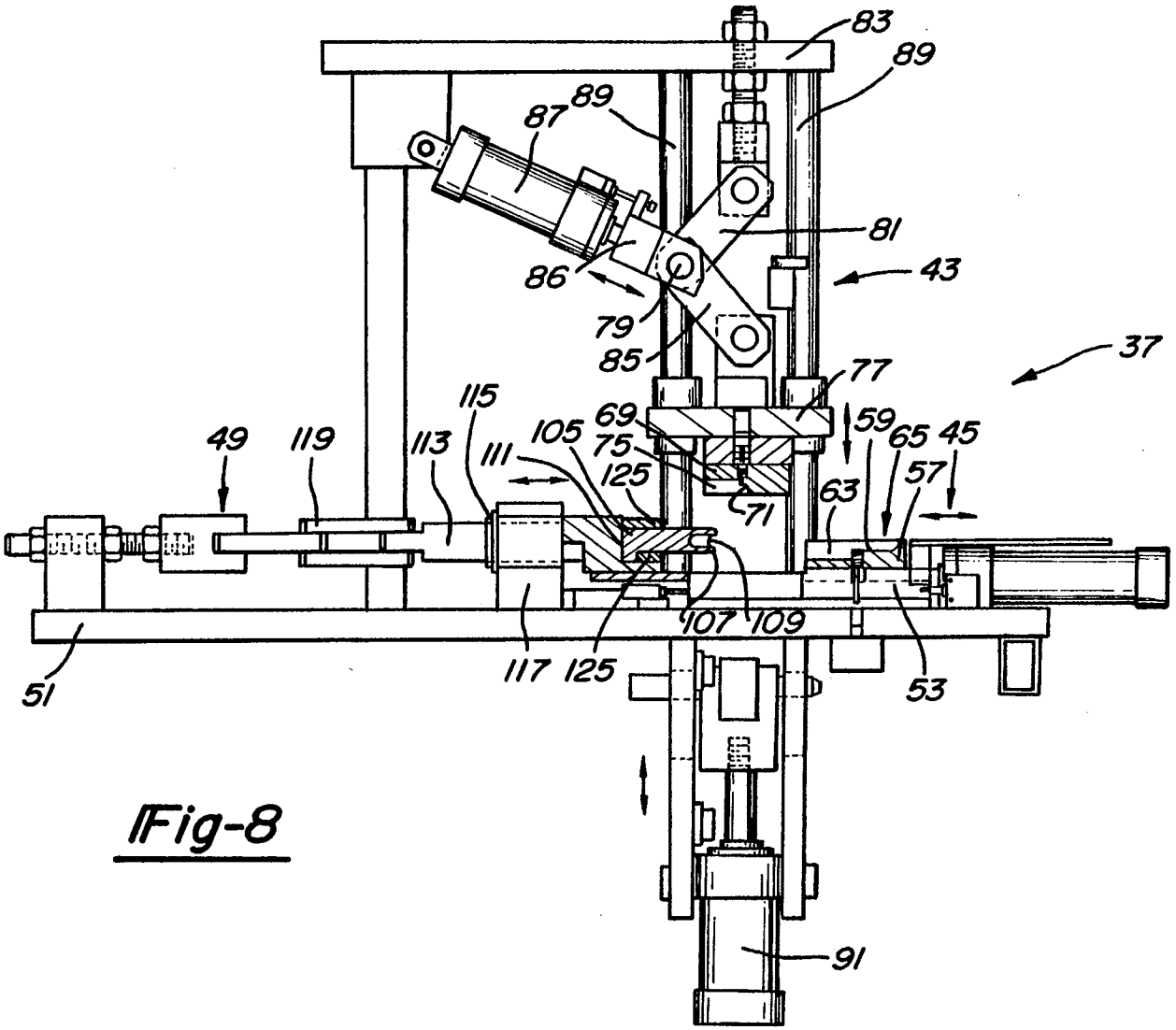
FIG. 8 is a cross sectional side elevation view of the same portion of the machine of FIG. 6 taken at line 8—8.

The preferred embodiment of the present invention machinery will now be described in greater detail. Referring to FIGS. 6–8, the primary actions within the automatic crossover machine 37 comprise a horizontal shuttle press mechanism 45, a vertical hydraulic press 43, horizontally actuated hydraulic punch mechanisms 47, and a horizontally actuated hydraulic bend forming die mechanism 49. The horizontal mechanisms are generally mounted onto an automatic crossover table 51 which is located along a horizontal plane adjacent to a lower shuttle die plate 53.

A precut tubular section 55 is placed into a lower shuttle die 57 which transfers horizontally with the lower shuttle die plate 53 into and away from the center of the vertical hydraulic press 43. The lower die 57 has a generally U-shaped configuration (when viewed from the top view) surrounding a cavity 63 which extends toward a side of the lower die 57 and has a channel 59 with a semi-circular cross sectional shape centrally cut thereacross; this channel 59 has a shape similar to a portion of the lower surface 61 of the tubular section 55. The cavity 63 of the lower die 57 acts to partially form the final bent shape of the partial blank 39. The tubular section 55 is located within this lower die 57 throughout all of the tasks performed in station 37. For ease of loading and unloading the tubular section 55, lower die 57 is hydraulically moved to an outboard position 65. When the lower die 57 is shuttled to its inboard position 67, an upper die 69 can be hydraulically compressed thereupon. The upper die 69 has a generally U-shaped configuration (when viewed from the top view) surrounding a cavity 75 which extends toward a side of the upper die 69 and has a channel 71 with a semi-circular cross sectional shape centrally cut thereacross which matches a portion of the top surface 73 of the tubular section 55. As with the lower die 57, the cavity 75 of the upper die 69 assists the forming of a portion of the bend for the partial blank 39. The upper die 69 is bolted to an upper die plate 77 mounted thereabove, which in turn, is mounted by a coupling 85 to a toggle assembly 79. Toggle assembly 79 has a second coupling 81 which is fixed at one end to the press crown 83 and a third coupling 86 pivotally connected to a hydraulic cylinder 87. In this manner, the upper die plate 77 can translate vertically along the tie bars 89 of the press 43. When the upper die 69 is compressibly closed against the lower die 57, each tubular section run 17 is retained therebetween.

As can be observed in FIGS. 6 and 7, a punching mechanism 47 is positioned adjacent to each end 15 of the tubular section 55. Each punching mechanism 47 is actuated by a hydraulic cylinder 91 which is mounted vertically below the automatic crossover table 51. The hydraulic cylinder 91 is coupled to a pair of toggle assemblies 93 each of which moves a punch rod 95 in a horizontal direction. Each toggle assembly 93 has one coupling 94 mounted to a stationary block 96 and a second coupling 98 oppositely connected to punch rod 95. Each punch rod 95 is retainably positioned relative to the automatic crossover table 51 through a stationary block 97 and collar 99 which surrounds the punch rod 95, such that the punch rod 95 can move inwardly and outwardly therefrom. A cylindrical shaped punch 101 is located on the inboard end of each punch rod 95. When the hydraulic cylinder 91 actuates the punch rods 95, each punch 101 is forcibly inserted into an end 15 of the tubular member 55. The punches 101 are sized slightly larger than the normal inside diameter 31 of the tubular member 55, such that when a punch 101 is inserted the end 15 of the tubular member 55 will be slightly expanded against the channels 71 and 59 which were created by the upper and lower dies, 69 and 57, respectively. In the arrangement shown, both punches are actuated simultaneously and while slightly expanding the diameter of the ends 15, serve to assist in the retention of the tubular member 55 throughout the subsequent forming operation. In the second embodiment of the present invention, these punches 101 fully form the cups 19 on each end of the tubular member.

For the preferred embodiment, within one of the punches 101 is a means 103 for filling the tubular section 55 with a water emulsifiable oil; the fluid filling means 103 is known as a punch bolt. Punch bolt 103 and the hydraulically pressured fluid dispensing apparatus in coordination therewith, pressurizes the water emulsifiable oil within the tubular section 55. This pressurized fluid serves to maintain the inside diameter 31 of tubular section 55 from collapsing throughout the forming operation.

After a very short time delay, a bend forming die 105 is then inserted into the upper and lower die cavities, 75 and 63, respectively. This can best be seen in FIGS. 6 and 8. This forming die 105, when viewed from the top as in FIG. 6, has a generally semi-circular shape on the leading edge 107 thereof and a frontal channel 109 therein. The trailing edge 111 of the bend forming die 105 is connected to a bend forming die rod 113 which is guided through a collar 115 in a stationary block 117. The bend forming die rod 113 is connected to a toggle assembly 119 of the type discussed above which, in turn, is actuated by a hydraulic cylinder 121. Accordingly, the bend forming die 105 is allowed to translate into and out of the upper and lower die cavities, respectively 75 and 63, in a generally horizontal direction. The bend forming die 105 compressibly pushes the center portion of the tubular section 55 against a matching semi-circular shape 123 and into channel 59 formed in the back side of the upper and lower dies, respectively 69 and 57. A pair of die stops 125, situated above and below the bend forming die 105, which comes in contact with the outside of the upper and lower dies, respectively 69 and 57, acts as a backup stop for limiting the travel of the bend forming die 105. Thus, the bend forming die 105 forms the generally straight configuration of tubular section 55 into the curved shape of the partial blank 39 having a central bend 13 and a pair of run bends 17 adjacent thereto. After performing its bending operation, the bend forming die 105 is pulled back, the punches 101 are removed from the ends 15, the fluid within the partial blank 39 is released and the upper die 69 is opened. The lower die 57 containing the partial blank 39 is then shuttled to its outboard position 65 for unloading of the partial blank 39. It should be noted that the bend forming die mechanism 49 is preferably mounted on the top side of the automatic crossover table 51. At this stage, in the second embodiment, a full crossover tube 11 has been produced.

In the preferred embodiment, a full crossover fitting 11 can be manufactured from the partial blank 39 by using the aforedescribed process and performing additional operations at a second station 40. As can best be observed in FIGS. 6 and 9, a robotic arm 127 and clamp 129 grasp the full crossover tube 11 out of the lower die 57 and the arm 127 pivotally swings toward the second station 40. The robot arm 127 and clamp 129 then insert the partial blank 39 into a channel 131 within a stationary die 133. Channel 131 has a cross sectional shape that is semi-circular thereacross to match the contour of a portion 135 of the full crossover tube 11.

Figure 9:
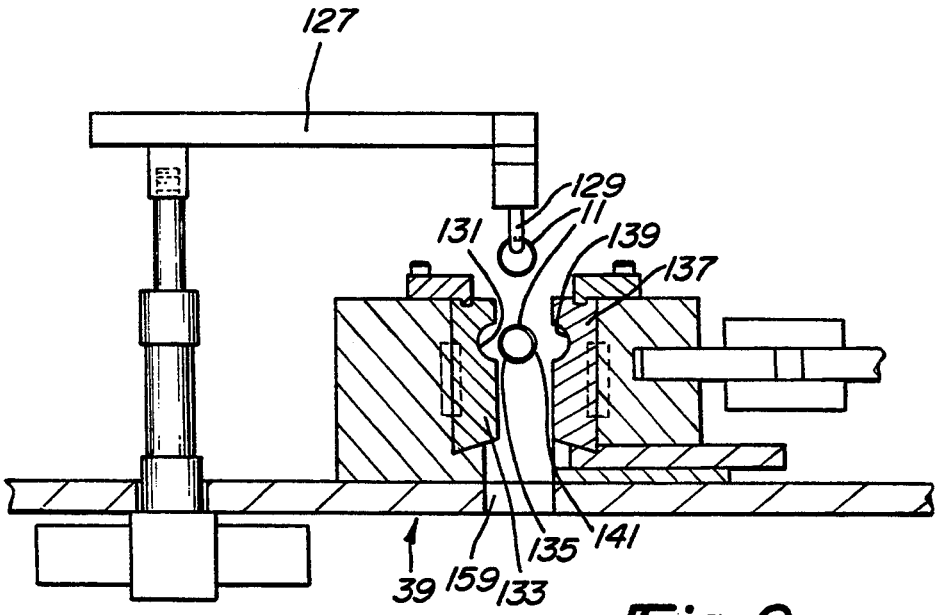
FIG. 9 is a cross sectional elevation view of the remaining portion of the machine of FIG. 6 taken at line 9—9.
Figure 10:
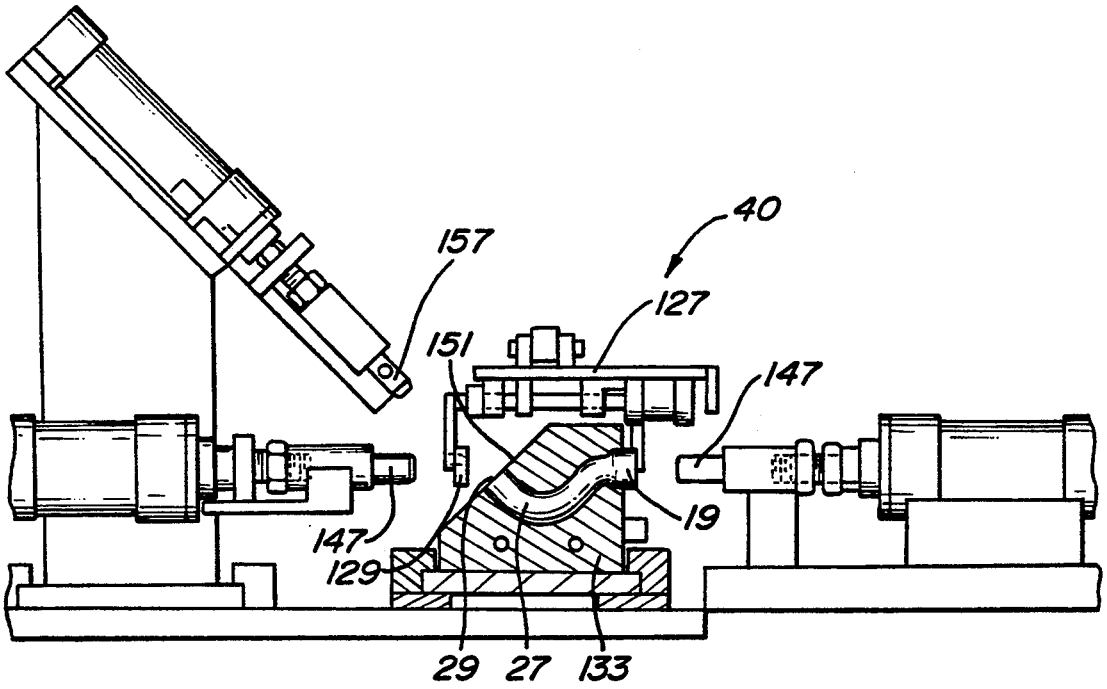
FIG. 10 is a cross sectional elevation view of the remaining portion of the machine of FIG. 6 taken at line 10—10.

Referring to. FIGS. 6, 9 and 10, a movable die 137 is then pneumatically closed against the stationary die 133. The movable die 137 also has a semi-circular shaped channel 139 thereacross matching the contour of an opposite portion 141 of the full crossover tube 11. When a pneumatic cylinder 143 and toggle assembly 145 close this movable die 137 against the stationary die 133, the partial blank 39 is then retained therebetween. Next, for the full crossover fitting 11, a pair of punches 147 are hydraulically inserted into each end 15 of the partial blank 39 to form the cup portions 19 against the mating die channels, 131 and 139. A completed full crossover fitting 11 is thereby created.

Figure 11:
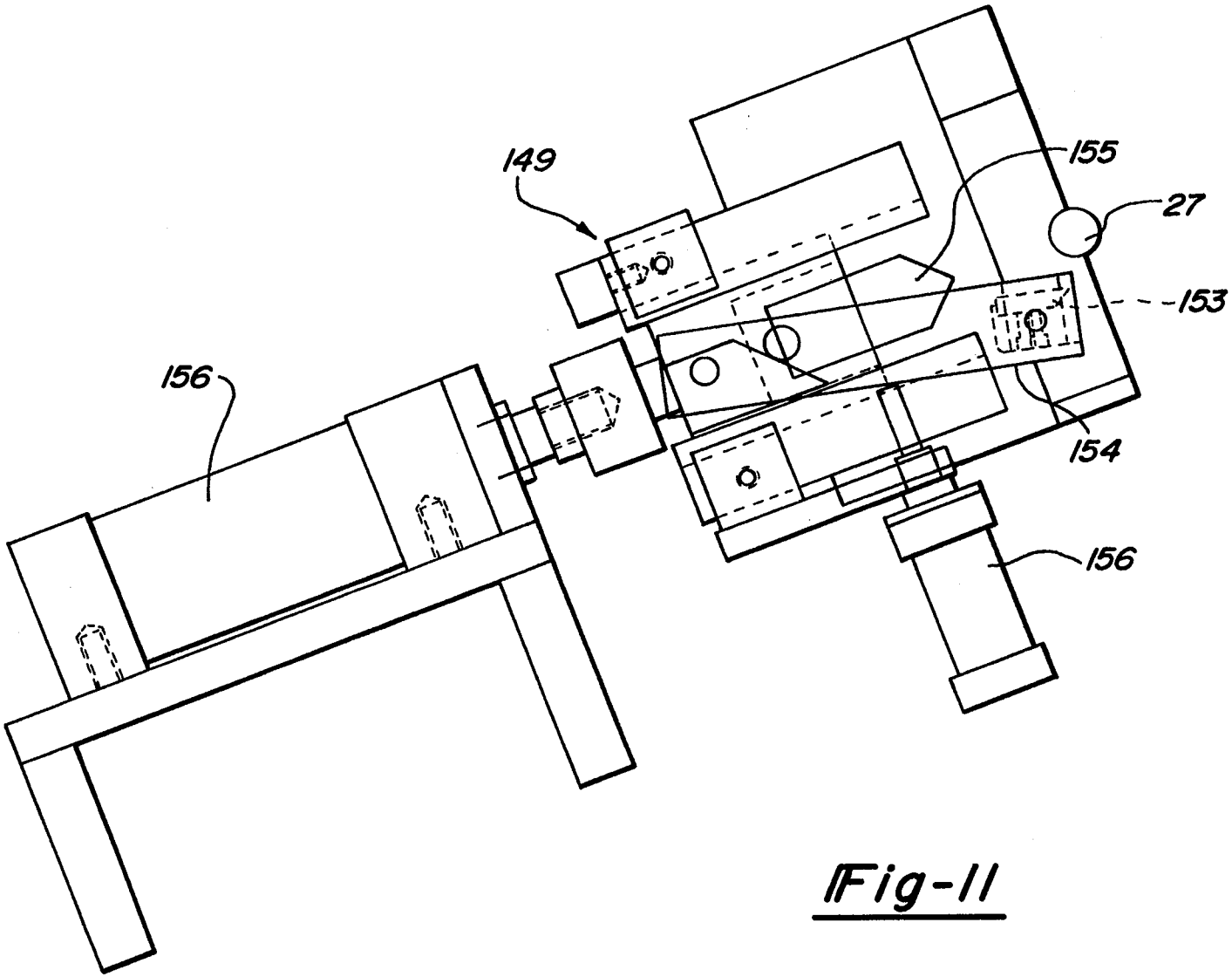
FIG. 11 is a top elevational view of a cutting mechanism employed in a second station of the machine of the present invention of FIG. 6.

For the half crossover fitting 27, prior to the preceding punching operation, a two stage cutting mechanism 149 is then moved across a surface 151 of the stationary and movable dies, respectively 133 and 137, such that one run end 17 15 of the partial blank 39 is cut therefrom. Cutting mechanism 149 is shown in FIGS. 6 and 11. This cut is generally at a 45° angle from the longitudinal axis of the partial blank 39 run end 15. In the preferred embodiment, this cutting mechanism 149 is comprised of a notching mechanism 153 that is cam operated; this cam 154 is part of the slide which pushes a shear blade 155 using a hydraulic cylinder 156. Notching mechanism 153 travels in an arc in front of shear blade 155 as shear blade 155 starts to move forward. At the mid point of the arc a portion of the partial blank 39 wall section is notched, thereby allowing easy entry of the pointed shear blade 155 as it continues to travel forward through the partial blank 39. Also, the notching prevents the severe distortion of the cut end that traditionally occurs during a cutting process without a preformed notch. An air cylinder (not shown) holds the arm of notching mechanism 153 in the full traveled position as shear blade 155 retracts, thus preventing damage to the cut edge of partial blank 39 and notching mechanism 153. This cut end becomes street end 29 of a half crossover tube 27.

A hydraulically actuated punch 157 is then forcibly inserted into the shear end of partial blank 39, thereby forming street end 29 of the half crossover fitting 27 against the inside of the channels, 131 and 139, created by the stationary and movable dies. This ensures that street end 29 has the proper toleranced inside and outside diameters, respectively 31 and 33. Simultaneously, the opposite punch 147 will be hydraulically inserted with the remaining run end 17 such that a cup 19 is formed. Punches 157 and 147; are then retracted and movable die 137 is opened. Ejector pins 158 centrally located within stationary die 133 and movable die 137, extract half crossover fitting 27 or full crossover fitting 11 from channels, 131 and 139, and the crossover fitting then falls into a chute 159 located between stationary die 133 and movable die 137.

While specific embodiments of the present invention machine and processes to make full and half crossover fittings have been disclosed, it will be appreciated that various modifications may be made to the current machine and processes without departing from the present invention. For example, a pair of punches have been described for expanding cup areas on the ends of the tubular section. Nevertheless thread formers could alternatively be inserted instead. Furthermore, while dies and punches have been disclosed as moving in a variety of vertical and horizontal directions, a machine would not depart from this invention if it had similar functions but operating from different directions. While copper material crossover fittings have been described in exemplary fashion, various other materials may be employed. It is intended by the following claims to cover these and any other departures from these disclosed embodiments which fall within the spirit of this invention.

The invention claimed is:

1. A machine for forming a metallic tubular section, said machine comprising:

first means for locating said tubular section thereupon, first means for retaining said tubular section therewithin, means for filling said tubular section with fluid and for then applying pressure to said fluid, first end forming means for expanding an end of said tubular section, means for forming at least one centrally located bend within said tubular section; and said first locating means, said first retaining means, said first end forming means, said fluid filling and pressurizing means, and said bending means, all being located proximate to one another such that said tubular section is generally at one location at a first station.

2. The machine of claim 1 wherein said first locating means comprises a lower die having a cavity extending toward a side thereof, said lower die having a channel with a semi-circular cross sectional shape centrally located thereacross for placement of said tubular section thereupon.

3. The machine of claim 2 further comprising:

a lower die plate for retaining said lower die, a shuttle mechanism for moving said lower die plate;

whereby said shuttle mechanism provides accessible loading and unloading of said tubular section from said lower die.

4. The machine of claim 3 wherein said first retention means comprises the combination of an upper die and said lower die, said upper die having a cavity extending toward a side thereof and having a channel with a semi-circular cross sectional shape centrally located thereacross, said upper die being movable after said lower die is shuttled to its inward position, whereby said upper die and said lower die cooperatively act to retain portions of said tubular section when said upper die is closed downward upon said lower die.

5. The machine of claim 4 wherein said bend forming means comprises a forming die having a forwardmost edge with a generally semi-circular shape, whereby when said forming die is forcibly inserted into said cavities of said upper and said lower dies, said forming die compressibly bends a portion of said tubular section against said channel of said upper and said lower dies.

6. The machine of claim 5 wherein said pressurized fluid is a water emulsifiable oil.

7. The machine of claim 1 wherein a first end forming means comprises a first pair of punches for being forcibly inserted into each end of said tubular section, whereby said first punches expand each of said tubular section ends against a predetermined cylindrical shape created by said channels of said upper and said lower dies.

8. The machine of claim 7 wherein said first end forming means forms a cup section at each end of said tubular section.

9. The machine of claim 8 Wherein said fluid filling and fluid pressurizing means are cooperatively located within said first end forming means, and wherein said fluid filling and pressurizing means inserts fluid within said tubular section and applies pressure to said fluid after said first end forming means is inserted within each end of said tubular section.

10. The machine of claim 9 wherein said tubular section is a full crossover fitting.

11. The machine of claim 1 further comprising:

second means for locating said tubular section thereupon, second means for retaining said tubular section therewithin, second means for forming an end of said tubular section; and said second locating means, said second retention means, and said second end forming means, all being located proximate to one another such that said tubular section is generally at a second location on said machine throughout these processes, said second location comprising a second station which is proximately distinct from said first station.

12. The machine of claim 11 wherein said second locating means comprises a stationary die with a semi-circular cross sectional shape centrally located thereacross, said channel being configured to mate with first outside portion of said tubular section.

13. The machine of claim 11 wherein said second retention means comprises a movable die having a channel with a semi-circular cross sectional shape centrally located thereacross, said channel is configured to mate with a second outside portion of said tubular section, whereby said movable die is operable to be compressed against said stationary die, thereby retaining said tubular section therebetween.

14. The machine of claim 11 wherein said second end forming means comprises a pair of second punches that are operable to be forcibly inserted into said tubular section's ends, thereby forcing the walls of said tubular section's ends against the inside of said channel created by said stationary die and said moving die to form cups thereupon.

15. The machine of claim 11 wherein:

a cutting means is located proximate to said second locating means, said second retention means, and said second end forming means, said cutting means comprises a means for notching a portion of said tubular section at a predetermined location and a means for shearing the portion of said tubular section previously notched, whereby said tubular section has an end portion cut therefrom thereby creating a half crossover fitting.

16. The machine of claim 11 further comprising a means for automatically unloading said tubular section from said second station.

17. The machine of claim 16 wherein said second station unloading means comprises an ejector pin within said stationary die, and a chute generally between and below said stationary die and said moving die, whereby said ejector pin is operable to push said tubular section out from said stationary die where said tubular section will gravitationally drop down into said chute.

18. The machine of claim 11 comprising a robotic means for unloading and transferring said tubular section from said first station to a position within said second station.

19. A machine for forming a metallic tubular section in a first station comprising:

a lower die which is horizontally movable along a shuttle mechanism, said lower die having a cavity extending toward a side thereof and having a channel with a semi-circular cross sectional shape centrally located thereacross, an upper die being vertically movable, said upper die having a cavity extending toward a side thereof and having a channel with a semi-circular cross sectional shape centrally located thereacross, said upper die and said lower die being operable to locate and retain a tubular section cooperatively therebetween, at least one first punch located at an end of said tubular section, said first punch being insertable within said end of said tubular section, said first punch having a means for filling fluid into said end of said tubular section and for pressurizing said fluid, a bend forming die having a forwardmost edge with a generally semi-circular shape, whereby when said bend forming die is forcibly inserted into said cavities of said upper and said lower dies, said bend forming die compressibly bends a portion of said tubular section against said channel of said upper and said lower dies;

whereby said lower die, said upper die, said first punch, said means for filling and pressurizing said fluid, and said bend forming die, all cooperatively acting in a single station to produce a full crossover fitting.

20. The machine of claim 19 wherein a pair of said first punches forms expanded cup sections upon each end of said tubular section prior to insertion of said bend forming die.

21. The machine of claim 19 further having a second station comprising:

a stationary die having a channel with a semi-circular cross sectional shape centrally located thereacross, said channel matching a first outside portion of said tubular section, a movable die having a channel with a semi-circular cross sectional shape centrally located thereacross, said channel matching a second outside portion of said tubular section, said movable die being forcibly compressed against said stationary die, thereby locating and retaining said tubular section cooperatively therebetween, a pair of second punches acting to form the ends of said tubular section; and said stationary die, said movable die, and said secondary punch, all being located proximate to one another such that said tubular section is generally at a second location on said machine throughout these processes, said second station being proximately distinct from said first station, whereby a half crossover fitting is produced.

22. The machine of claim 21 wherein there is a means for cutting off a portion of said tubular section prior to insertion of said pair of second punches.

23. A machine for producing a metallic tubular section, said machine comprising:

means for locating said tubular section thereupon, means for retaining said tubular section therewithin, means for forming an end of said tubular section, said locating means, said retention means, and said end forming means, all being located proximate to one another such that said tubular section is generally at one location on said machine throughout these processes; and means for cutting off a portion of said tubular section therefrom, said cutting means comprising means for notching a portion of said tubular section at a predetermined location and means for shearing the portion of said tubular section previously notched.

24. The machine of claim 23 wherein said locating means comprises a stationary die having a channel with a semi-circular cross sectional shape centrally located thereacross, said channel being configured to mate with a first outside portion of said tubular section.

25. The machine of claim 23 wherein: said retention means comprises a movable die having a channel with a semi-circular cross sectional shape centrally located thereacross, said channel being configured to mate with a second outside portion of said tubular section, whereby said movable die is operable to be compressed against said stationary die, thereby retaining said tubular section therebetween.

26. The machine of claim 23 wherein said end forming means comprises a punch that is operable to be forcibly inserted into said tubular section's cut end, thereby forcing the walls of said tubular section's cut end against the inside of said channel created by said stationary die and said moving die to remove any deformations caused by said cutting means.

27. The machine of claim 23 further comprising means for automatically unloading said tubular section from a second station wherein said cutting means is located.

28. A method of producing a crossover fitting which comprises:

(a) locating said tubular section, within a die at a single station, said tubular section having been precut from a continuous tube, (b) retaining said tubular section within a die set at said single station, (c) filling said tubular section with fluid at said single station, (d) pressurizing said fluid within said tubular section at said single station;

(e) bending a portion of said tubular section with a bend forming die at said single station; and (f) expanding at least one end of said tubular section at said single station.

29. The method of claim 28 further comprising the additional steps at a second station:

(a) locating said tubular section into a second die, (b) retaining said tubular section within a second die set, (c) forming an end of said tubular section; and (d) unloading said tubular section from said die set, thereby creating a full crossover fitting.

30. The method of claim 29 further having the additional steps of notching said tubular section and shearing the notched portion of said tubular section, thereby creating a half crossover fitting.

* * * * *